US009051810B1

(12) United States Patent
Cuffe et al.

(10) Patent No.: US 9,051,810 B1
(45) Date of Patent: Jun. 9, 2015

(54) FRAC VALVE WITH PORTED SLEEVE

(71) Applicant: EirCan Downhole Technologies, LLC, The Woodlands, TX (US)

(72) Inventors: Christopher J. Cuffe, The Woodlands, TX (US); John Cuffe, Ballymurphy Innishannon (IE); Keith B. Willhelm, Houston, TX (US)

(73) Assignee: EirCan Downhole Technologies, LLC, The Woodlands, TX (US)

( * ) Notice: Subject to any disclaimer, the term of this patent is extended or adjusted under 35 U.S.C. 154(b) by 0 days.

(21) Appl. No.: 14/305,099

(22) Filed: Jun. 16, 2014

Related U.S. Application Data

(63) Continuation-in-part of application No. 13/815,601, filed on Mar. 12, 2013, now Pat. No. 8,757,265.

(51) Int. Cl.
*E21B 43/26* (2006.01)
*E21B 34/06* (2006.01)
*E21B 34/00* (2006.01)

(52) U.S. Cl.
CPC ..... *E21B 34/066* (2013.01); *E21B 43/26* (2013.01); *E21B 2034/007* (2013.01)

(58) Field of Classification Search
CPC .. E21B 34/066; E21B 43/26; E21B 2034/007
See application file for complete search history.

(56) References Cited

U.S. PATENT DOCUMENTS

| | | | |
|---|---|---|---|
| 4,896,722 | A | 1/1990 | Upchurch |
| 4,915,168 | A | 4/1990 | Upchurch |
| 5,291,947 | A | 3/1994 | Stracke |
| 5,299,640 | A | 4/1994 | Streich et al. |
| 6,333,699 | B1 | 12/2001 | Zierolf |
| 6,333,700 | B1 | 12/2001 | Thomeer et al. |
| 6,359,569 | B2 | 3/2002 | Beck et al. |
| 6,759,968 | B2 | 7/2004 | Zierolf |
| 6,789,619 | B2 | 9/2004 | Carlson et al. |

(Continued)

FOREIGN PATENT DOCUMENTS

| | | | |
|---|---|---|---|
| GB | 2420133 | B | 11/2006 |
| WO | 2012/066290 | A2 | 5/2012 |

OTHER PUBLICATIONS

Fraley, Karen et al., RFID Technology for Downhole Well Applications, *Touch Briefings 2007 . . . Oil & Gas Review OTC Edition* pp. 60-61.

(Continued)

*Primary Examiner* — William P Neuder
*Assistant Examiner* — Richard Alker
(74) *Attorney, Agent, or Firm* — Keith B Willhelm

(57) ABSTRACT

Frac valves used in completing oil and gas wells are provided. The valves comprise a cylindrical housing adapted for assembly into a liner for a well. The valve housing defines a conduit for the passage of fluids through the housing. Preferably the conduit has a substantially uniform diameter. The housing has a port which can allow fluids to pass from the conduit to the exterior of the valve. The port may be shut off or left open by a valve body mounted on the housing. Preferably, the valve body is mounted between inner and outer walls provided in the housing. An actuator is provided to move the valve body between its open and closed positions. It comprises a receiver that is adapted to receive an activation signal. Thus, the valve may be actuated by introducing a transmitter into the housing conduit which transmits an activation signal.

20 Claims, 7 Drawing Sheets

(56) References Cited

U.S. PATENT DOCUMENTS

| | | | |
|---|---|---|---|
| 6,915,848 | B2 | 7/2005 | Thomeer et al. |
| 6,989,764 | B2 | 1/2006 | Thomeer et al. |
| 7,252,152 | B2 | 8/2007 | LoGiudice et al. |
| 7,283,061 | B1 | 10/2007 | Snider et al. |
| 7,385,523 | B2 | 6/2008 | Thomeer et al. |
| 7,400,263 | B2 | 7/2008 | Snider |
| 7,503,398 | B2 | 3/2009 | LoGiudice et al. |
| 7,714,741 | B2 | 5/2010 | Snider et al. |
| 8,044,820 | B2 | 10/2011 | Snider et al. |
| 8,267,178 | B1 | 9/2012 | Sommers et al. |
| 8,276,674 | B2 | 10/2012 | Lopez de Cardenas et al. |
| 8,286,717 | B2 | 10/2012 | Giroux et al. |
| 8,297,367 | B2 | 10/2012 | Chen et al. |
| 8,757,265 | B1 | 6/2014 | Cuffe et al. |
| 2001/0054969 | A1 | 12/2001 | Thomeer et al. |
| 2007/0285275 | A1 | 12/2007 | Purkis et al. |
| 2009/0223670 | A1 | 9/2009 | Snider |
| 2009/0230340 | A1 | 9/2009 | Purkis |
| 2009/0308588 | A1 | 12/2009 | Howell et al. |
| 2010/0089587 | A1 | 4/2010 | Stout |
| 2010/0314106 | A1 | 12/2010 | Tubel |
| 2011/0248566 | A1 | 10/2011 | Purkis |
| 2011/0284214 | A1 | 11/2011 | Ayoub et al. |
| 2012/0006562 | A1 | 1/2012 | Speer et al. |
| 2012/0037380 | A1 | 2/2012 | Arizmendi, Jr. et al. |
| 2012/0085548 | A1 | 4/2012 | Fleckenstein et al. |
| 2012/0298243 | A1 | 11/2012 | Zierolf |

OTHER PUBLICATIONS

Marathon Oil Corporation, Completions (published at http://www.marathonoil.com/About_Us/Technology/Upstream_Technology/Completions/) (Nov. 29, 2012).

Marathon Oil Corporation, RFID Downhole—Using RFID (or Radio Frequency Identification to Enhance Operations . . . Drilling and Completion Technologies (Jul. 2011).

ORIO™ Toe Valve (Copyright 2012 Team Oil Tools).

Schlumberger, Falcon Ball—Actuated Frac Valve (2012).

Schlumberger, Falcon Hydraulic—Actuated Frac Valve (2012),.

Snider, Phil et al., RFID Downhole, *Drilling Engineers Association* (Jun. 2009).

Snider, Philip et al., AADE 2009NTCE-16-04: RFID Downhole Tools and Development for the Drilling Environment, *2009 National Technical Conference & Exhibition*, New Orleans, Louisiana.

Snider, Philip et al.,, Marathon, Partners Adapt RFID Technology for Downhole Drilling, Completion Applications, *Drilling Contractor* (Mar./Apr. 2007).

Weatherford, Application Answers ARMS Advanced Reservoir Management System (copyright 2011-2012).

Weatherford, RFID Advanced Reservoir Isolation Device (ARID) (2013).

FRAC VALVE WITH PORTED SLEEVE

FIELD OF THE INVENTION

The present invention relates to valves used in oil and gas wells and, more particularly to improved sliding sleeve valves and methods of using sliding sleeve valves. The novel valves and methods are particularly suited for use as frac valves in completing oil and gas wells and in methods of fracturing hydrocarbon bearing formations.

BACKGROUND OF THE INVENTION

Hydrocarbons, such as oil and gas, may be recovered from various types of subsurface geological formations. The formations typically consist of a porous layer, such as limestone and sands, overlaid by a nonporous layer. Hydrocarbons cannot rise through the nonporous layer, and thus, the porous layer forms a reservoir in which hydrocarbons are able to collect. A well is drilled through the earth until the hydrocarbon bearing formation is reached. Hydrocarbons then are able to flow from the porous formation into the well.

In what is perhaps the most basic form of rotary drilling methods, a drill bit is attached to a series of pipe sections referred to as a drill string. The drill string is suspended from a derrick and rotated by a motor in the derrick. A drilling fluid or "mud" is pumped down the drill string, through the bit, and into the well bore. This fluid serves to lubricate the bit and carry cuttings from the drilling process back to the surface. As the drilling progresses downward, the drill string is extended by adding more pipe sections.

When the drill bit has reached the desired depth, larger diameter pipes, or casings, are placed in the well and cemented in place to prevent the sides of the borehole from caving in. Cement is introduced through a work string. As it flows out the bottom of the work string, fluids already in the well, so-called "returns," are displaced up the annulus between the casing and the borehole and are collected at the surface.

Once the casing is cemented in place, it is perforated at the level of the oil bearing formation to create openings through which oil can enter the cased well. Production tubing, valves, and other equipment are installed in the well so that the hydrocarbons may flow in a controlled manner from the formation, into the cased well bore, and through the production tubing up to the surface for storage or transport.

This simplified drilling and completion process, however, is rarely possible in the real world. Hydrocarbon bearing formations may be quite deep or otherwise difficult to access. Thus, many wells today are drilled in stages. An initial section is drilled, cased, and cemented. Drilling then proceeds with a somewhat smaller well bore which is lined with somewhat smaller casings or "liners." The liner is suspended from the original or "host" casing by an anchor or "hanger." A seal also is typically established between the liner and the casing and, like the original casing, the liner is cemented in the well. That process then may be repeated to further extend the well and install additional liners. In essence, then, a modern oil well typically includes a number of tubes wholly or partially within other tubes.

Moreover, hydrocarbons are not always able to flow easily from a formation to a well. Some subsurface formations, such as sandstone, are very porous. Hydrocarbons are able to flow easily from the formation into a well. Other formations, however, such as shale rock, limestone, and coal beds, are only minimally porous. The formation may contain large quantities of hydrocarbons, but production through a conventional well may not be commercially practical because hydrocarbons flow though the formation and collect in the well at very low rates. The industry, therefore, relies on various techniques for improving the well and increasing production from formations which are relatively nonporous.

One technique involves drilling a well in a more or less horizontal direction, so that the borehole extends along a formation instead of passing through it. More of the formation is exposed to the borehole, and the average distance hydrocarbons must flow to reach the well is decreased. Another technique involves creating fractures in a formation which will allow hydrocarbons to flow more easily. Indeed, the combination of horizontal drilling and fracturing, or "frac'ing" or "fracking" as it is known in the industry, is presently the only commercially viable way of producing natural gas from the vast majority of North American gas reserves.

Fracturing typically involves installing a production liner in the portion of the well bore which passes through the hydrocarbon bearing formation. In shallow wells, the production liner may actually be the casing suspended from the well surface. In either event, the production liner is provided, by various methods discussed below, with openings at predetermined locations along its length. Fluid, most commonly water, then is pumped into the well and forced into the formation at high pressure and flow rates, causing the formation to fracture and creating flow paths to the well. Proppants, such as grains of sand, ceramic or other particulates, usually are added to the frac fluid and are carried into the fractures. The proppant serves to prevent fractures from closing when pumping is stopped.

A formation usually is fractured at various locations, and rarely, if ever, is fractured all at once. Especially in a typical horizontal well, the formation usually is fractured at a number of different points along the bore in a series of operations or stages. For example, an initial stage may fracture the formation near the bottom of a well. The frac job then would be completed by conducting additional fracturing stages in succession up the well.

Some operators prefer to perform a frac job on an "open hole," that is without cementing the production liner in the well bore. The production liner is provided with a series of packers and is run into an open well bore. The packers then are installed to provide seals between the production liner and the sides of the well bore. The packers are spaced along the production liner at appropriate distances to isolate the various frac zones from each other. The zones then may be fractured in a predetermined sequence. The packers in theory prevent fluid introduced through the liner in a particular zone from flowing up or down the well bore to fracture the formation in areas outside the intended zone.

Certain problems arise, however, when an open hole is fractured. The distance between packers may be substantial, and the formation is exposed to fluid pressure along that entire distance. Thus, there is less control over the location at which fracturing of a formation will occur. It will occur at the weakest point in the frac zone, i.e., the portion of the well bore between adjacent packers. Greater control may be obtained by increasing the number of packers and diminishing their separation, but that increases the time required to complete the frac job. Moreover, even if packers are tightly spaced, given the extreme pressures required to fracture some formations and the rough and sometimes frangible surface of a well bore, it may be difficult to achieve an effective seal with a packer. Thus, fluid may flow across a packer and fracture a formation in areas outside the intended zone.

In part for such reasons, many operators prefer to cement the production liner in the well bore before the formation is fractured. Cement is circulated into the annulus between the production liner and well bore and is allowed to harden before the frac job is commenced. Thus, frac fluid first penetrates the cement in the immediate vicinity of the inner openings before entering and fracturing the formation. The cement above and below the liner openings serves to isolate other parts of the formation from fluid pressure and flow. Thus, it is possible to control more precisely the location at which a formation is fractured when the production liner is first cemented in the well bore. Cementing the production liner also tends to more reliably isolate a producing formation than does installing packers. Packers seat against a relatively small portion of the well bore, and even if an effective seal is established initially, packers may deteriorate as time passes.

There are various methods by which a production liner is provided with the openings through which frac fluids enter a formation. In a "plug and perf" frac job, the production liner is made up from standard lengths of casing. The liner does not have any openings through its sidewalls. It is installed in the well bore, either in an open bore using packers or by cementing the liner, and holes then are punched in the liner walls. The perforations typically are created by so-called perforation guns which discharge shaped charges through the liner and, if present, adjacent cement.

The production liner typically is perforated first in a zone near the bottom of the well. Fluids then are pumped into the well to frac the formation in the vicinity of the perforations. After the initial zone is fracked, a plug is installed in the liner at a point above the fractured zone to isolate the lower portion of the liner. The liner then is perforated above the plug in a second zone, and the second zone is fracked. That process is repeated until all zones in the well are fractured.

The plug and perf method is widely practiced, but it has a number of drawbacks. Chief among them is that it can be extremely time consuming. The perf guns and plugs must be run into the well and operated individually, often times at great distance and with some difficulty. After the frac job is complete, it also may be necessary to drill out or otherwise remove the plugs to allow production of hydrocarbons through the liner. Thus, many operators prefer to frac a formation using a series of frac valves.

Such frac valves typically include a cylindrical housing that may be threaded into and forms a part of a production liner. The housing defines a central conduit through which frac fluids and other well fluids may flow. Ports are provided in the housing that may be opened by actuating a sliding sleeve. Once opened, fluids are able to flow through the ports and fracture a formation in the vicinity of the valve.

The sliding sleeves in such valves traditionally have been actuated either by creating hydraulic pressure behind the sleeve or by dropping a ball on a ball seat which is connected to the sleeve. Typical multi-stage fracking systems will incorporate both types of valves. Halliburton's RapidSuite sleeve system and Schlumberger's Falcon series sleeves, for example, utilize a hydraulically actuated "initiator" valve and a series of ball-drop valves. Hydraulically actuated initiator valves also are disclosed in U.S. Pat. No. 8,267,178 to M. Sommers et al.

More particularly, the production liner in those systems is provided with a hydraulically actuated sliding sleeve valve which, when the liner is run into the well, will be located near the bottom of the well bore in the first fracture zone. The production liner also includes a series of ball drop valves which will be positioned in the various other fracture zones extending uphole from the first zone.

A frac job will be initiated by increasing fluid pressure in the production liner. The increasing pressure will actuate the sleeve in the bottom, hydraulic valve, opening the ports and allowing fluid to flow into the first fracture zone. Once the first zone is fractured, a ball is dropped into the well and allowed to settle on the ball seat of the ball-drop valve immediately uphole of the first zone. The seated ball isolates the lower portion of the production liner and prevents the flow of additional frac fluid into the first zone. Continued pumping will shift the seat downward, along with the sliding sleeve, opening the ports and allowing fluid to flow into the second fracture zone. The process then is repeated with each ball-drop valve up hole from the second zone until all zones in the formation are fractured.

Such systems have been used successfully in any number of well completions. The series of valves avoids the time consuming process of running and setting perf guns and plugs. Instead, a series of balls are dropped into the well to successively open the valves and isolate downhole zones. It may still be necessary, however, to drill out the liner to remove the balls and seats prior to production. Unlike plug and perf jobs, there also is a practical limit to the number of stages or zones that can be fractured.

That is, the seat on each valve must be big enough to allow passage of the balls required to actuate every valve below it. Conversely, the ball used to actuate a particular valve must be smaller than the balls used to actuate every valve above it. Given the size constraints of even the largest production liners, only so many different ball and seat sizes may be accommodated. Halliburton's RapidStage ball-drop valves, for example, only allow up to twenty intervals to be completed. While that capability is not insignificant, operators may prefer to perform an even greater number of stages using a single liner installation.

Sliding sleeves which are controlled using radio frequency identification (RFID) technology have been proposed for use in frac valves, and various RFID controlled sliding sleeve valves have been used in other well operations. For example, U.S. Pub. Appl. 2007/0,285,275 to D. Purkis et al. discloses a circulation sub having a sliding sleeve valve which is used to control circulation through a drill string. As drilling progresses and drilling mud is circulated through a well, pressure imbalances can occur along the drill string that make it more difficult to sweep cuttings up to the surface. By incorporating various valves in the drill string, such issues may be addressed by selectively diverting fluid out of the drill string through the valves.

The circulation subs disclosed in Purkis '275 generally comprise a cylindrical housing that may be threaded into a drill string. The housing has a central conduit through which drilling fluids are circulated. Ports are provided in the housing to allow fluid to be diverted from the central conduit into the well bore. A sleeve is mounted on the interior of the housing in a recess in the central conduit. The sleeve is actuated by pumping hydraulic fluid above a piston integrally formed in the sleeve. As fluid is pumped above the piston, the sleeve will slide away from and uncover the ports.

The hydraulic pump is controlled by a programmable electronic controller. The controller is connected to a RFID antenna which is adapted to pick up signals from encoded RFID transmitters passed through the drill string. When an operator wishes to open the sleeve in a particular valve, an "open valve" signal is encoded into an RFID transmitter. The signal is unique for that particular valve. When the RFID transmitter is pumped through the drill string and is detected by the corresponding valve, the pump is actuated to open the valve. Other valves in the drill string may be opened by circulating additional RFID transmitters through the drill string.

U.S. Pat. No. 7,252,152 to M. LoGiudice et al. and U.S. Pat. No. 7,503,398 to M. LoGiudice et al. disclose RFID-controlled sliding sleeve valves which are similar in many respects to the valves disclosed in Purkis '275. The LoGiudice valves are disclosed for use as casing circulation diverter tool, as part of a stage cementing apparatus, or for other unspecified downhole fluid flow regulating apparatus. Like the Purkis '275 valves, the valves disclosed in LoGiudice '152 and LoGiudice '398 have a sliding sleeve that is mounted on the interior of the tool housing in a recess in a central conduit. The valves have a programmable controller connected to an RFID antenna which can detect an encoded signal from a RFID tag passed through the conduit. The sleeve is actuated, however, by a linear actuator instead of the hydraulic pump provided in the Purkis '275 valves.

Such RFID controlled sliding sleeve valves may have certain advantages in the context of the specific well operations for which they are intended. They do not rely on differing ball sizes to actuate the sleeves, and so a greater number of valves may be incorporated into a particular conduit. They are not well suited, however, for incorporation into a production liner and use in fracking operations. Frac fluids typically include proppants, such as grains of sand, ceramic or other particulates, which can be quite abrasive and can interfere with the operation of sliding sleeve valves. Moreover, if the production liner will be cemented in place prior to fracturing the formation, cement passing through the valve conduit when the casing is cemented may hang up in the valve and interfere with subsequent operation of the sleeve.

The statements in this section are intended to provide background information related to the invention disclosed and claimed herein. Such information may or may not constitute prior art. It will be appreciated from the foregoing, however, that there remains a need for new and improved sliding sleeve frac valves and for new and improved methods for fracking formations using sliding sleeve frac valves. Such disadvantages and others inherent in the prior art are addressed by various aspects and embodiments of the subject invention.

SUMMARY OF THE INVENTION

The subject invention, in its various aspects and embodiments, is directed generally to valves used in oil and gas wells and, more particularly to improved sliding sleeve valves and methods of using sliding sleeve valves. The novel valves and methods are particularly suited for use as frac valves in completing oil and gas wells and in methods of fracturing hydrocarbon bearing formations.

One aspect of the invention provides for a frac valve for a well liner. The frac valve has a cylindrical housing which is adapted for assembly into a liner to be installed in a well. The housing defines a conduit for passage of fluids through the housing. It has an inner wall and an outer wall. Both the inner wall and outer walls are provided with a port allowing passage of fluids. A cylindrical sleeve valve body is mounted between the inner wall and the outer wall. The valve body is adapted for movement between a closed position, in which fluid communication between the ports is shut off, and an open position, in which fluid may flow between the conduit and the exterior of the housing through the ports. Pressure relief ports are provided to allow fluid to be displaced from or flow into the annular space between the inner wall sleeve and the outer wall sleeve as the valve body reciprocates therein. The frac valve also has an actuator that is adapted to move the valve body from the closed position to the open position. The actuator comprises a receiver adapted to receive an activation signal from a transmitter introduced into the conduit. The actuator, therefore, can be activated to actuate the valve body upon receiving an activation signal from a transmitter introduced into the housing conduit.

Other aspects provide a frac valve for a well liner. The frac valve has a housing adapted for assembly into a liner for a well. The housing defines a cylindrical conduit for passage of fluids through the housing which has a substantially uniform diameter. The housing also defines a port allowing passage of fluids. A cylindrical sleeve valve body is mounted on the housing. The valve body is adapted for movement between a closed position, in which fluid communication through the port is shut off, and an open position in which fluid may flow through the port. The frac valve also has an actuator that is adapted to move the valve body from the closed position to the open position. The actuator comprises a receiver adapted to receive an activation signal from a transmitter introduced into the conduit. The actuator, therefore, can be activated to actuate the valve body upon receiving an activation signal from a transmitter introduced into the housing conduit.

Other aspects and embodiments provide frac valves for a well liner. The valves comprise a cylindrical housing adapted for assembly into a liner for a well. The housing defines a conduit for passage of fluids through the housing. The housing has an inner wall and an outer wall which are spaced from each other to define an annular space. The inner and outer walls each have a plurality of ports therein allowing passage of fluids between the conduit and the exterior of the housing. A valve body is mounted in the annular space between the inner wall and the outer wall. The valve body comprises a cylindrical sleeve which is repeatably moveable between a closed position, in which fluid communication between the ports is shut off, and an open position, in which fluid may flow between the conduit and the exterior of the housing through the ports. The valve body defines a passage allowing fluid displaced by movement of the valve body to flow between portions of the annular space above the valve body and portions of the annular space below the valve body. The valves also comprise an actuator adapted to move the sleeve between the closed position and the open position. The actuator comprises a receiver adapted to receive an activation signal from a transmitter introduced into the conduit.

Especially preferred embodiments include such frac valves where the receiver and transmitter operate in radio frequencies and radio frequency identification protocols and technology are utilized. Various aspects will utilize active reader, passive tag (ARPT) technology, including batter assisted passive tags, while other embodiments may include passive reader active tag (PRAT) or active reader active tag (ARAT) systems.

Yet other aspects and embodiments provide a frac valve where the actuator is a linear actuator, or where the actuator is a hydraulic actuator. In other embodiments, valves are provided with a housing assembled from a first connection sub, an inner wall sleeve and an outer wall sleeve releasably engaged with the first connection sub, an actuator housing sleeve releasably engaged with the inner and outer wall sleeves; and a second connection sub releasably engaged with the actuator housing sleeve.

The subject invention also includes liners incorporating one or more embodiments of the novel valves, and to methods of using those valves and liners in a well, for example, to fracture a formation. Such aspects include methods where a liner comprising one or more embodiments of the valves is incorporated into a liner and the liner is installed in a well.

Such methods further include opening the frac valve by introducing a transmitter into the housing conduit. The transmitter is encoded with an activation signal which is received by the receiver, whereupon the actuator is activated to move the valve body from the closed position to the open position. Fluid then is pumped through the opened frac valve to fracture the formation.

Other aspects of the novel methods include installing a liner by cementing the liner in the well Another embodiment includes such methods where the frac valve is shut by introducing a second transmitter into the housing conduit. The transmitter is encoded with a second activation signal which is received by the receiver, whereupon the actuator is activated to move the valve body from the open position to the closed position.

Still other aspects provide such methods where the liner comprises a first and a second frac valve. The first frac valve is shut and the second valve is opened by introducing a second transmitter into the housing conduits of the first and second frac valves. The transmitter is encoded with a second activation signal. When the activation signal is received by the receiver in the first frac valve the actuator in the first frac valve is activated to move the valve body from the open position to the closed position. When it is received by the receiver in the second frac valve the actuator in the second frac valve is activated to move the valve body from the closed position to the open position. Fluid then is pumped through the opened second frac valve to fracture the formation. In other embodiments, the activation signal is received by the receiver in the second frac valve. The actuator in the second frac valve then is activated to move the valve body from the closed position to the open position after a time delay so that the second frac valve is opened after the first frac valve is closed.

Further aspects and embodiments provide methods of fracturing a formation in a well which comprise installing a liner in the well. The liner has an uphole frac valve and a downhole frac valve. Each of those valves comprises a cylindrical housing adapted for assembly into a liner for a well. The housing also defines a conduit for passage of fluids through the housing and a port allowing passage of fluids. A valve body is mounted on the housing and adapted for movement between a closed position, in which fluid communication through the port is shut off, and an open position, in which fluid may flow between the conduit and the exterior of the housing through the port. The valves also comprise an actuator. The actuator is adapted to move the valve body from the closed position to the open position and comprises a receiver. The frac valves are actuated in a predetermined fashion to fracture the formation in a predetermined sequence. The actuation of the valves includes actuating the downstream frac valve by introducing a transmitter into the conduit of the downhole frac valve through the conduit of the uphole valve. The transmitter is encoded with an activation signal which is received by the receiver in the actuator of the downhole frac valve. The ports in the uphole frac valve and the downhole frac valve and the transmitter are sized such that the transmitter is precluded from passing through the ports in the uphole frac valve and is capable of passing through the ports in the downhole frac valve. The transmitted, therefore, is assured of reaching the downhole valve.

In other aspects and embodiments, the novel sliding sleeve valves may be adapted for use in other methods, such as controlling mud circulation through a drill string and in cementing a liner in various stages.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide a better understanding of the invention and the manner in which it may be practiced. The subject invention encompasses other embodiments consistent with the claims set forth herein.

Figure 1A:
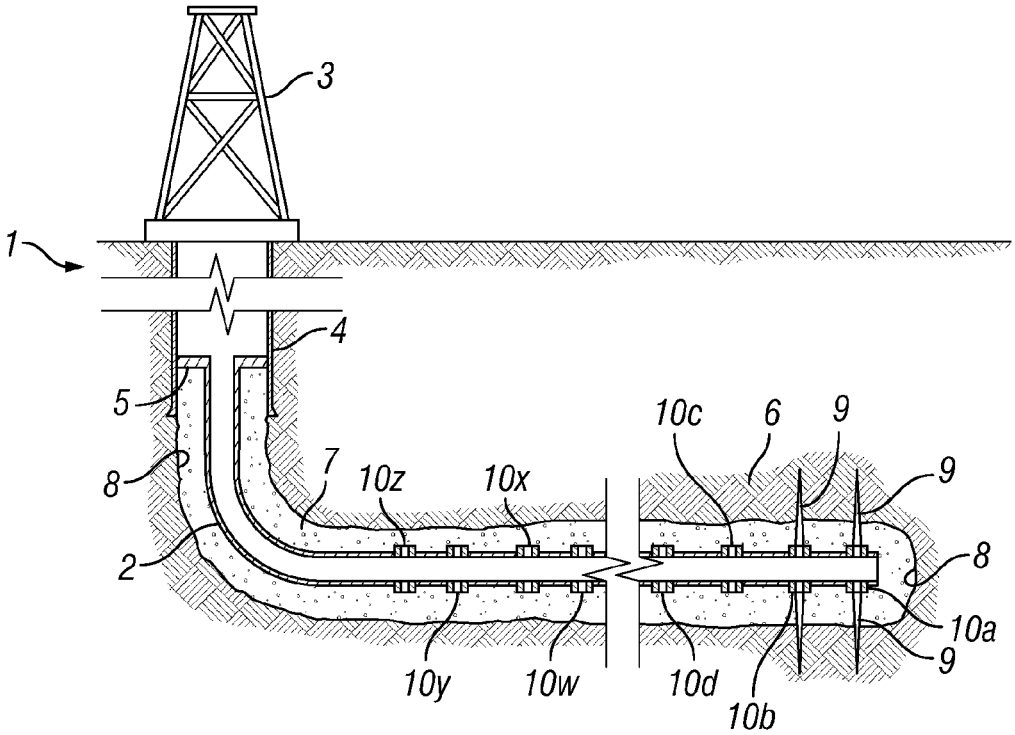
FIG. 1A is a schematic illustration of a preferred embodiment 2 of the liner assemblies of the subject invention showing the initial stages of a frac job.

In the drawings and description that follows, like parts are identified by the same reference numerals. The drawing figures are not necessarily to scale. Certain features of the invention may be shown exaggerated in scale or in somewhat schematic form and some details of conventional design and construction may not be shown in the interest of clarity and conciseness.

DESCRIPTION OF ILLUSTRATIVE EMBODIMENTS

The present invention generally relates to valves used in oil and gas well operations and especially to frac valves used in completing oil and gas wells. Broader embodiments of the novel valves comprise a cylindrical housing adapted for assembly into a tubular string such as a liner for a well. The valve housing defines a conduit for the passage of fluids through the housing. Preferably the conduit has a substantially uniform diameter. The housing has a port which can allow fluids to pass from the conduit to the exterior of the valve. The port may be shut off or left open by a valve body mounted on the housing. Preferably, the valve body is mounted between inner and outer walls provided in the housing. An actuator is provided to move the valve body between its open and closed positions. It comprises a receiver that is adapted to receive an activation signal. Thus, the valve may be actuated by introducing a transmitter into the housing conduit which transmits an activation signal.

For example, a first preferred frac valve 10 is illustrated in FIGS. 1-5. As may be seen in the schematic representations of FIG. 1, a series of frac valves 10 may be incorporated into production liner 2 which forms part of a typical oil and gas well 1. Well 1 is serviced by a derrick 3 and various other surface equipment (not shown). The upper portion of well 1 is provided with a casing 4. Production liner 2 has been installed in the lower portion of casing 4 via a liner hanger 5. It will be noted that the lower part of well 1 extends generally horizontally through a hydrocarbon bearing formation 6 and that liner 2 has cemented in place. That is, cement 7 has been introduced into the annular space between liner 2 and the well bore 8.

Figure 1B:
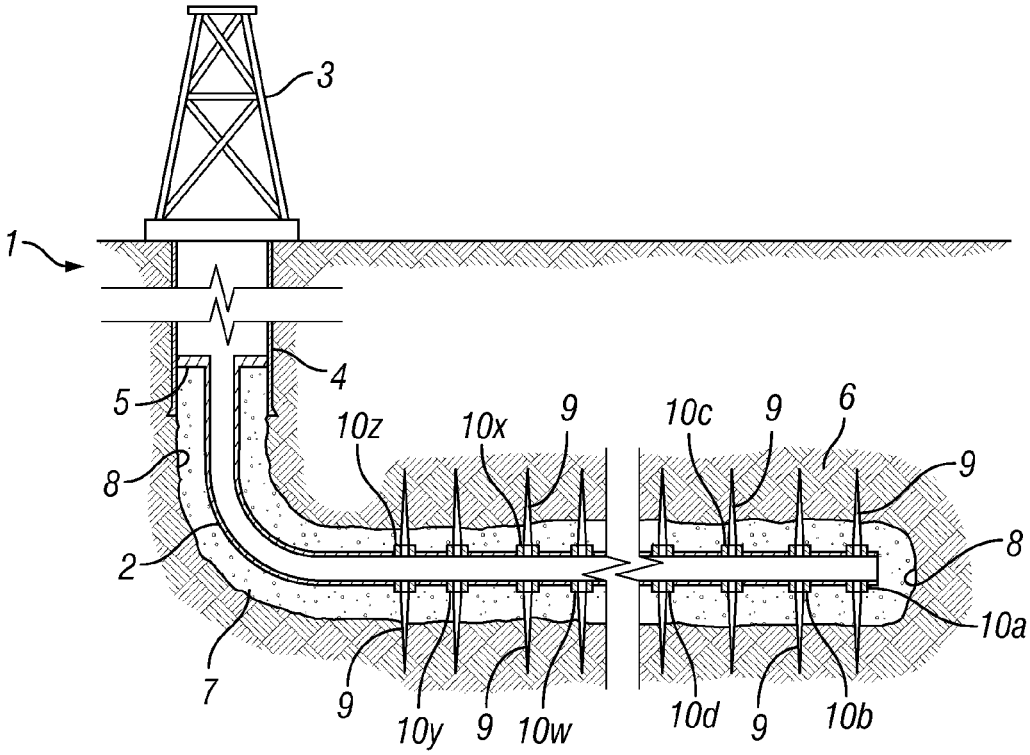
FIG. 1B is a schematic illustration of novel liner assembly 2 shown in FIG. 1A showing completion of the frac job.

FIG. 1A shows well 1 after the initial stages of a frac job have been completed. As discussed in greater detail below, a typical frac job will generally proceed from the lowermost zone in a well to the uppermost zone. FIG. 1A, therefore, shows that fractures 9 have been established adjacent valves 10*a* and 10*b* in the first two zones near the bottom of well 1. Uphole zones in well 1 will be fracked in succession until, as shown in FIG. 1B, all stages of the frac job have been completed and fractures 9 have been established in all zones. It also will be noted that production liner 2 is shown only in part as such liners may extend for a substantial distance. The portion of liner 2 not shown also will incorporate a number of valves 10, and well 1 will be provided with additional fractures 9 in the areas not shown in FIG. 1.

Preferred novel frac valve 10 is shown in greater detail in FIGS. 2-5. As shown therein, frac valve 10 generally comprises a housing 11, a sliding sleeve valve body 70, and an actuator 80. Housing 11, as it typical of many downhole tools, is generally cylindrical and defines an axial, central conduit 12 through which well fluids may pass. It also has ports 31 and 41 which, when valve body 70 is in an open position, allow fluid to pass from conduit 12 to the exterior of housing 11. It will be noted, however, that as exemplified in valve 10, conduit 12 preferably has a substantially uniform diameter. That is, for reasons discussed below, the cylindrical conduit 12 defined by and passing through housing 11 is substantially free of any profiles or recesses.

Figure 2:
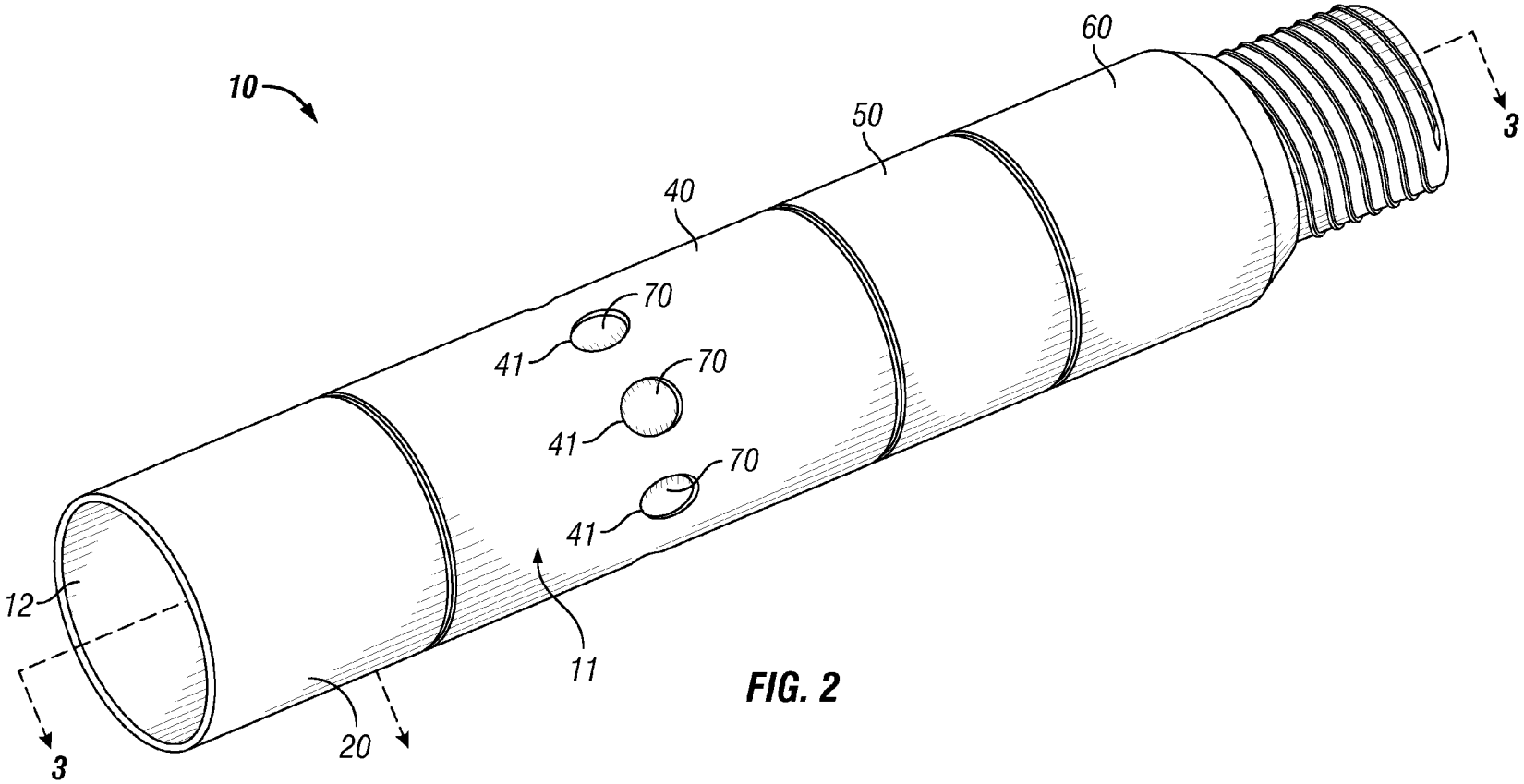
FIG. 2 is a perspective view of a preferred embodiment 10 of the frac valves of the subject invention showing frac valve 10 in its closed or run-in position.
Figure 3A:
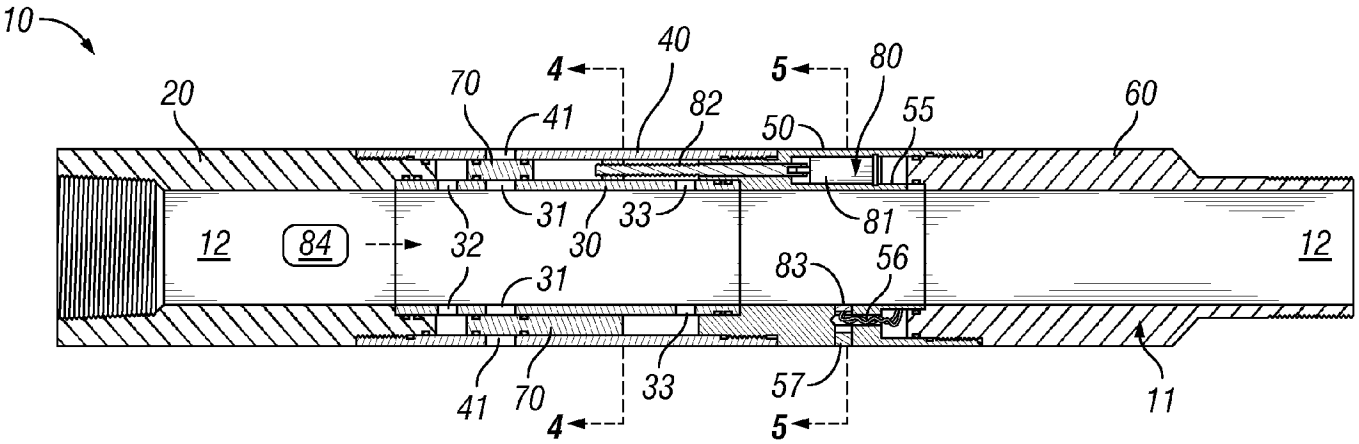
FIG. 3A is an axial cross-sectional view taken along line 3-3 of FIG. 2 of novel frac valve 10 showing frac valve in its closed or run-in position.
Figure 3B:
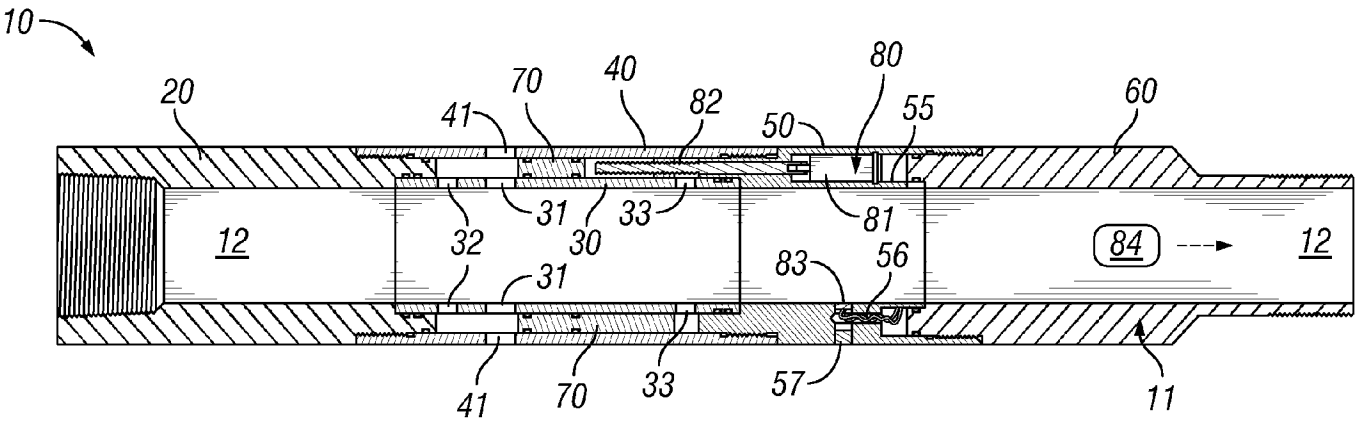
FIG. 3B is an axial cross-sectional view similar to FIG. 3A showing novel frac valve 10 in its open position.

More particularly, again as may be seen in FIGS. 2-3, housing 11 generally comprises a top connection sub 20, an inner wall sleeve 30, an outer wall sleeve 40, an actuator housing sleeve 50, and a bottom connection sub 60. Top connection sub 20 and bottom connection sub 60 are adapted for assembly into liner joints and other tubulars. Thus, for example, top connection sub 20 is provided with internal threads and bottom connection sub 60 is provided with external threads so that valve 10 may be threaded into production liner 2.

Inner wall sleeve 30 and outer wall sleeve 40 are similar in construction. They each are generally cylindrical sleeves and each has a port therein that allows passage of well fluids. Preferably, as best seen in FIGS. 2-3, they are provided with a plurality of ports, such as ports 31 in inner wall sleeve 30 and ports 41 in outer wall sleeve 40. Ports 31 and 41 may be arranged radially around a portion of, respectively, inner wall sleeve 30 and outer wall sleeve 40. The precise number and arrangement of the ports, and their cross section, in general are not critical to practicing the invention. They may be varied as desired to provide whatever flow capacity as may be desired for the novel valves.

Inner wall sleeve 30 and outer wall sleeve 40 are assembled to top connection sub 20, for example, by threaded connections as shown in FIG. 3. O-rings mounted in grooves or other suitable sealing members may be provided between top connection sub 20 and inner wall sleeve 30 and outer wall sleeve 40 to provide a fluid tight seal. It will be noted from FIG. 3 that when assembled to top connection sub 20, inner wall sleeve 30 and outer wall sleeve 40 provide housing 11 with, respectively, an inner wall and an outer wall which are spaced from each other. Inner wall sleeve 30 and outer wall sleeve 40 thus define an annular space in which valve body 70 may be mounted.

Valve body 70 is a generally cylindrical body and is mounted for reciprocating movement between an open position and a closed position. More particularly, valve body 70 is adapted for movement between a closed position, shown in FIG. 3A, in which fluid communication through ports 31 and 41 is shut off, and an open position, shown in FIG. 3B, in which fluid may flow through ports 31 and 41. Thus, when valve body 70 is in its open position, fluid is able to flow between housing conduit 12 and the exterior of valve 10. It will be noted that inner wall sleeve 30 is provided with ports, preferably two sets of ports 32 and 33 which allow fluid to be displaced from or flow into the annular space between inner wall sleeve 30 and outer wall sleeve 40 as valve body 70 reciprocates therein. When valve 10 is run into a well, ports 32 and 33 preferably are provided with burst disks (not shown) or the like that will prevent the ingress of fluids into ports 32 and 33 and the annular space in which valve body 70 is mounted. The disks preferably will be rated to burst at relatively low pressures generated in the annular space, thereby allowing actuation of valve body 70, but to burst only at relatively high pressures generated in conduit 12.

Actuator housing sleeve 50 also is a generally cylindrical body which is assembled as shown in FIG. 3 to inner wall sleeve 30 and outer wall sleeve 40, for example, by threaded connections. O-rings mounted in grooves or other suitable sealing members may be provided between actuator housing sleeve 50 and inner wall sleeve 30 and outer wall sleeve 40 to provide a fluid tight seal between those components. Actuator housing sleeve 50 also is assembled to bottom connection sub 60, for example, by threaded connections. O-rings mounted in grooves or other suitable sealing members also may be provided between actuator housing sleeve 50 and bottom connection sub 60 to provide a fluid tight seal.

Figure 5:
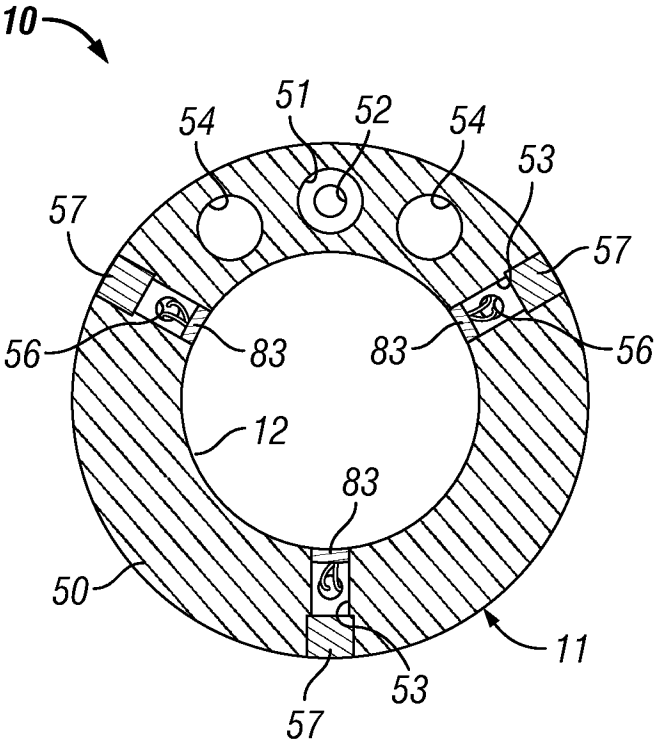
FIG. 5 is a radial cross-sectional view taken along line 5-5 of FIG. 3A of novel frac valve 10.
Figure 4:
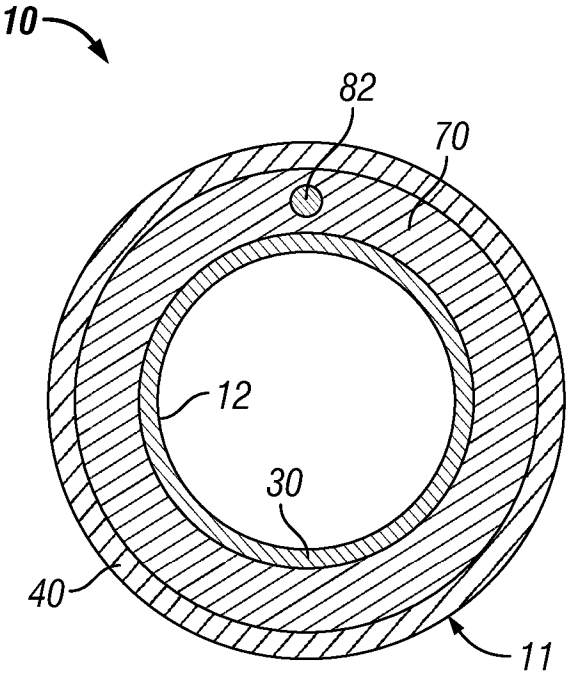
FIG. 4 is a radial cross-sectional view taken along line 4-4 of FIG. 3A of novel frac valve 10.

A primary purpose of the actuator housing sleeve 50 is to accommodate an actuator, such as linear actuator 80, and its various mechanical and electrical components. Actuator 80, as may be seen in FIG. 3, generally comprises a motor, such as an electrically powered motor 81, a connector assembly coupling motor 81 to valve body 70, such as connector rod 82, a programmable controller unit (not shown) for controlling motor 81 in response to signals received by receivers, such as RFID receivers 83, and batteries (not shown) for powering actuator 80 as required. Accordingly, as best appreciated by comparing FIGS. 3 and 5, actuator housing sleeve 50 is provided with a suitable cavity, such as longitudinal bore 51 which accommodates motor 81 and a smaller, concentric bore 52 which accommodates connector rod 82. As shown in FIG. 5, suitable cavities, such as radial bores 53 are provided in actuator housing sleeve 50 to accommodate receivers 83. Longitudinal bores 54 are provided to accommodate batteries (not shown) for powering actuator 80. An annular cavity, such as cavity 55 shown in FIG. 3, is provided to accommodate a programmable controller (not shown) and, along with passageways 56, to allow passage of required wiring (shown schematically).

Motor 81 is a conventional electrically powered rotary motor of the type that is widely available for use in downhole oil and gas well tools. It has a rotating drive shaft that is connected to one end of connector rod 82. The other end of connector rod 82 is threaded into a threaded bore provided in valve body 70, as may be appreciated best by comparing FIGS. 3 and 4. Thus, as motor 81 is operated to rotate its drive shaft in opposite directions, connector rod 82 will rotate and induce valve body 70 to translate between its open and closed positions.

Motor 81 is controlled by a programmable controller (not shown) which is connected to receivers 83. Receivers 83 are adapted to receive an activation signal from a transmitter passed through conduit 12 of valve 10, such as transmitter tag 84 shown schematically in FIG. 3. When an activation signal is detected by receivers 83, it will be inputted into the controller which will interpret the signal and activate motor 81 in accordance with the instructions encoded in the controller.

Preferably, as in frac valve 10, the receivers and transmitters are of the type commonly employed in radio frequency identification ("RFID") systems. RFID systems are capable of sending and receiving data wirelessly via electromagnetic radiation in the radio frequency range, most commonly, in the range of 125 to 134 Hz. They are used in many industries, including oil and gas, and many such conventional systems and components are commercially available and may be used in the subject invention.

RFID systems typically comprise a reader which, at a minimum, is capable of receiving a signal from a tag, but more commonly is capable of interrogating the tag and receiving responsive signals as well. If two-way communications are required, different radio frequencies usually are used for transmitting and receiving signals so as to avoid signal interference. Thus, RDIF readers and tags typically have antennas to transmit and receive radio waves. They also typical incorporate integrated circuits capable of storing and processing data, modulating and demodulating radio frequency signals, and handling other chip functions, such as collecting DC power from a radio signal. Those components typically are packaged in a hermetically sealed casing.

The tag is encoded with appropriate information or instructions for communicating with the reader, and vice versa. The reader will be connected to a processor, either on board in the reader or in the controller, that includes suitable code for handling RFID operations. The controller typically will include processors and code for storing and processing data received by the reader from a tag and generating appropriate control signals to, for example, a motor or other actuating mechanism or the RFID reader.

More typically, actuator 80 will utilize an active reader, passive tag (ARPT) RFID system. That is, receivers 83 will be an active RFID reader capable of transmitting interrogation signals to a passive tag. Passive tags are not provided with a battery or other power source. Lacking power, they rely on power from the signal received from a reader to send a response signal. They are inexpensive and, because they do not have a battery, can be made quite small, providing more flexibility in delivering the tag through a production liner.

If desired, however, battery assisted passive tags may be used. Battery assisted passive tags incorporate a small battery to assist in powering a tag's return signal. Otherwise, passive tags must be in fairly close proximity to a reader in order to receive sufficient energy to generate a return transmission. Providing a power source on a tag can increase the distance at which communication may be established between the tag and a reader and, thus, increase the reliability and extent of communications as a tag passes through the tool conduit.

Still other types of RFID systems may be used, such as passive reader active tag (PRAT) or active reader active tag (ARAT) systems. The former systems utilize a powered tag which transmits signals to a passive reader and may provide advantages if conserving the life of the motor batteries is important. ARAT systems utilize readers and tags that are both active.

The reader and tag may be encoded at the factory to perform more or less standard operations. Preferably, however, the tag and reader, as well as the actuator controller, will be programmable in the field with appropriate data and instructions to perform whatever series of operations are most appropriate for the job at hand. The tag and reader also may be may be programmed to respond to particular radio frequencies, or to transmit signals or respond to signals at specified power levels so as to optimize communications between a particular tag and its target reader. Programmable components are widely available and may be programmed, for example, with a laptop computer.

While a single receiver may be used, the actuator preferably is provided with a number of receivers. For example, as seen best in FIG. 5, actuator 80 in valve 10 has three RFID receivers 83 situated radially around the inner wall of actuator housing sleeve 50. Multiple receivers can increase the likelihood of establishing communication with an RFID tag passing through valve 10. It also will be appreciated receivers 83 may be shielded by internal shielding or by actuator housing sleeve 50 to limit the reception angle of receivers 83. The tags used most commonly will generate an omnidirectional signal, but in any event, such factors may be varied to provide appropriate communication zones in valves 10.

Figure 6A:
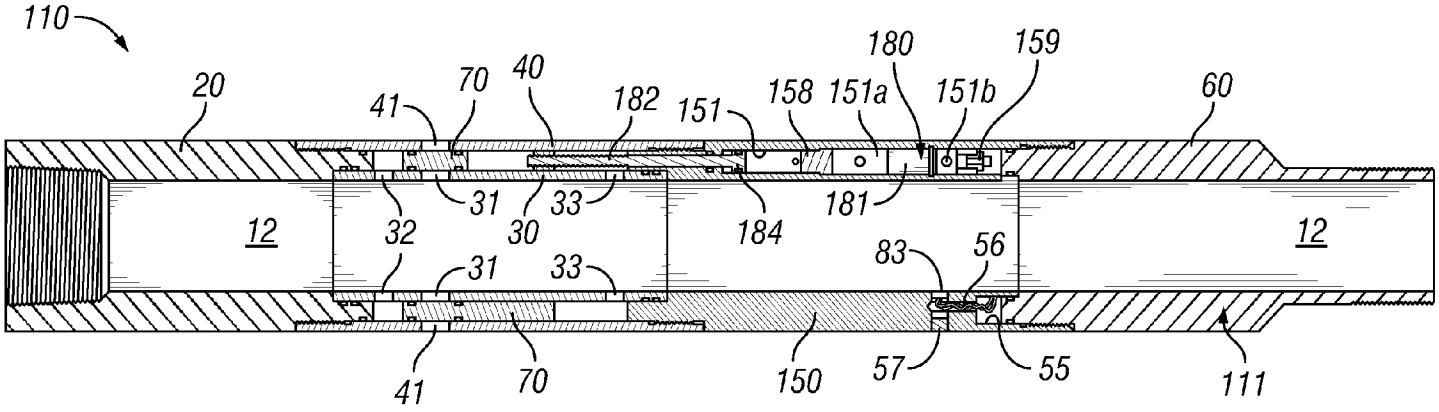
FIG. 6A is an axial cross-sectional view, similar to the view of FIG. 3A, showing a second preferred embodiment 110 of the novel frac valves of the subject invention in its closed or run-in position.
Figure 6B:
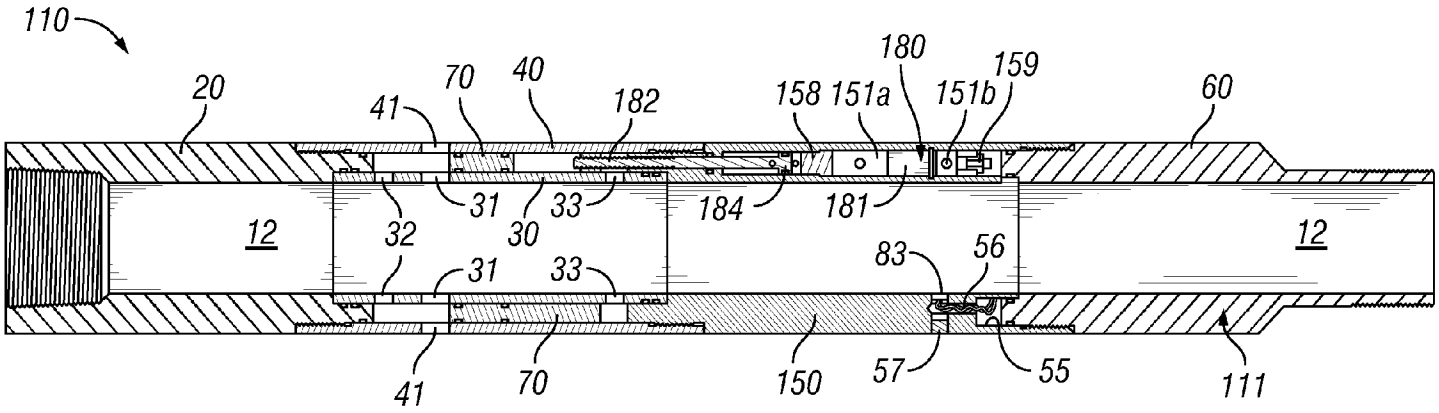
FIG. 6B is an axial cross-sectional view similar to FIG. 6A showing novel frac valve 110 in its open position.

A second preferred frac valve 110 is illustrated in FIG. 6. Frac valve 110 is similar in many respects to valve 10 and may be used and operated in a production liner in the same manner as valve 10. More particularly, as may be seen in FIG. 6, frac valve 110 generally comprises a housing 111, sliding sleeve valve body 70, and an actuator 180. Housing 11 in turn generally comprises top connection sub 20, inner wall sleeve 30, outer wall sleeve 40, an actuator housing sleeve 150, and bottom connection sub 60. Valve body 70 is slidably mounted in housing 111 between inner wall sleeve 30 and outer wall sleeve 40. Housing 111 defines an axial, central conduit 12 through which well fluids may pass and which, as in valve 10, has a substantially uniform diameter.

Housing 111 also is provided with ports 31 and 41. Valve body 70 is adapted for movement between a closed position, shown in FIG. 6A, in which fluid communication through ports 31 and 41 is shut off, and an open position, shown in FIG. 6B, in which fluid may flow through ports 31 and 41. Thus, when valve body 70 is in its open position, fluid is able to flow between housing conduit 12 and the exterior of valve 110.

Actuator 180, in contrast to actuator 80, is a hydraulic actuator. Thus, as may be seen by comparing FIG. 3 and FIG. 6, instead of motor 81 and connecting rod 82, it comprises a hydraulic pump 181 which drives a piston rod 182. Like actuator 80, however, actuator 180 includes a programmable controller unit (not shown) for controlling pump 181, receivers, such as RFID receivers 83, and batteries (not shown) for powering actuator 180. Actuator housing sleeve 150 in large part accommodates the various components of actuator 180. More specifically, it is provided with a suitable cavity, such as longitudinal bore 151 which accommodates pump 181 and serves to define, along with plugs 158 and 159, hydraulic chambers 151*a* and 151*b* above and below pump 181. Smaller, concentric bores also are provided in actuator housing sleeve 150 to accommodate piston rod 182. Like actuator housing sleeve 50, actuator housing sleeve 150 also is provided with radial bores 53 to accommodate receivers 83, longitudinal bores 54 to accommodate batteries (not shown), an annular cavity to accommodate a programmable controller (not shown), and passageways 56 to allow passage of required wiring (shown schematically).

Except for the specific manner in which the sleeves are actuated, valves 10 and 110 may be controlled and operated in substantially the same ways. Like motor 81 in valve 10, pump 181 is controlled by a programmable controller (not shown). The controller is connected to receivers 83 and is able to process data received by receivers 83 and activate pump 181 in accordance with the instructions encoded therein.

Pump 181 is a conventional electrically powered hydraulic pump of the type that is widely available for use in downhole oil and gas well tools. It preferably operates in a closed hydraulic system. For example, when pump 181 is activated, it draws fluid from hydraulic chamber 151*a* and discharges into hydraulic chamber 151*b*, or vice versa. Suitable passageways (not shown) are provided to establish fluid communication between the top of piston rod 182 and hydraulic chamber 151*a* and between the bottom of piston rod 182 and hydraulic chamber 151*b*. Piston rod 182 has an enlarged head 184 which slidably engages its borehole so that it acts a translating piston when hydraulic pump is activated. The other end of piston rod 182 is coupled to valve body 70, for example, via a threaded connection. Thus, as pump 181 is operated and fluid is pumped into and out of hydraulic chambers 151*a* and 151*b*, fluid will be displaced below or above piston rod 182 which will in turn cause valve body 70 to translate between its closed and open positions, as may be seen by comparing FIG. 6A and FIG. 6B.

Figure 7:
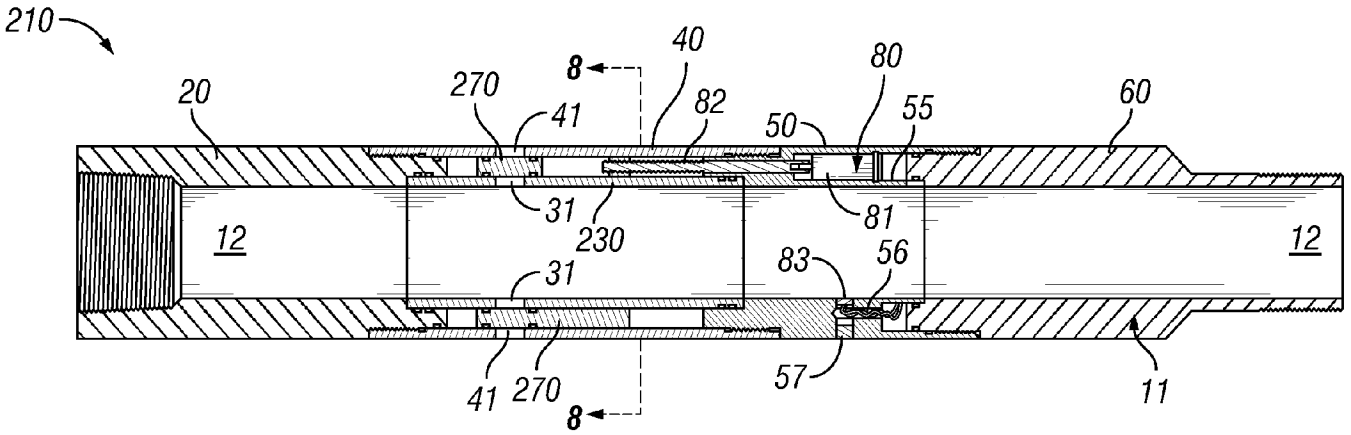
FIG. 7 is an axial cross-sectional view, similar to the views of FIGS. 3A and 6A, showing a third preferred embodiment 210 of the novel frac valves in its closed or run-in position.
Figure 8:
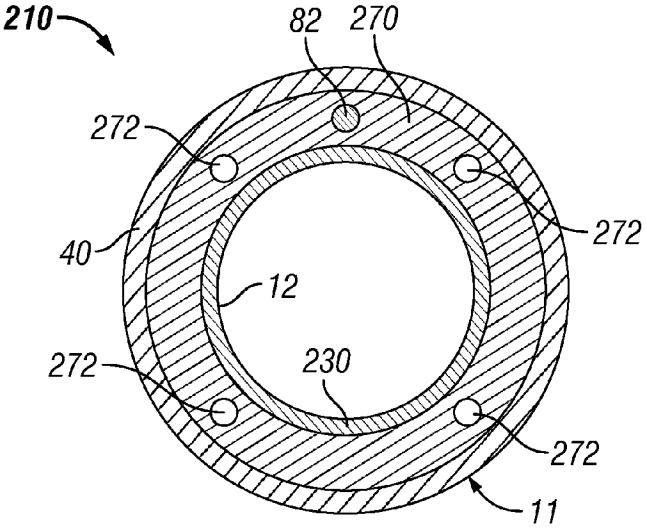
FIG. 8 is a radial cross-sectional view taken along line 8-8 of FIG. 7 of novel frac valve 210.

A third preferred frac valve 210 is illustrated in FIGS. 7 and 8. Frac valve 210 is similar in many respects to valve 10, and it may be used and operated in a production liner in the same manner as valves 10 and 110. More particularly, as may be seen in FIG. 7, frac valve 210 generally comprises a housing 11, a sliding sleeve valve body 270, and linear actuator 80. Housing 11 in turn generally comprises top connection sub 20, an inner wall sleeve 230, outer wall sleeve 40, actuator housing sleeve 50, and bottom connection sub 60. Valve body 270 is slidably mounted in housing 11 between inner wall sleeve 230 and outer wall sleeve 40. Housing 11 defines an axial, central conduit 12 through which well fluids may pass and which, as in valve 10, has a substantially uniform diameter.

Housing 11 is provided with ports 31 and 41. Valve body 270 is adapted for movement between a closed position, shown in FIG. 7, in which fluid communication through ports 31 and 41 is shut off and an open position, similar to the position of valve body 70 in valve 10 shown in FIG. 3B, in which fluid may flow through ports 31 and 41. Thus, when valve body 270 is in its open position, fluid is able to flow between housing conduit 12 and the exterior of valve 210.

In contrast to inner wall sleeve 30 of valve 10, however, inner wall sleeve 230 of valve 210 lacks ports 32 and 33 which allow fluid to be displaced from or flow into the annular space between inner wall sleeve 30 and outer wall sleeve 40 as valve body 70 reciprocates therein. Instead, valve body 270 is provided with a passage allowing fluid displaced by movement of valve body 270 to flow between portions of the annular space above and below valve body 270. For example, as seen in FIG. 8, valve body 270 is provided with four passageways 272 which extend axially through valve body 270. As valve body 270 reciprocates within the annular space between inner wall sleeve 230 and outer wall sleeve 40, therefore, fluid displaced on one side of valve body 270 is able to flow through passageways 272 to the other side of valve body 270. The number, size, and placement of such passageways, of course, may be varied as desired. In any event, it will be appreciated that by allowing displaced fluids to flow through valve body 270, the force required to actuate sleeve 270 and the power requirements for operation of valve 210 may be greatly reduced.

Figure 9:
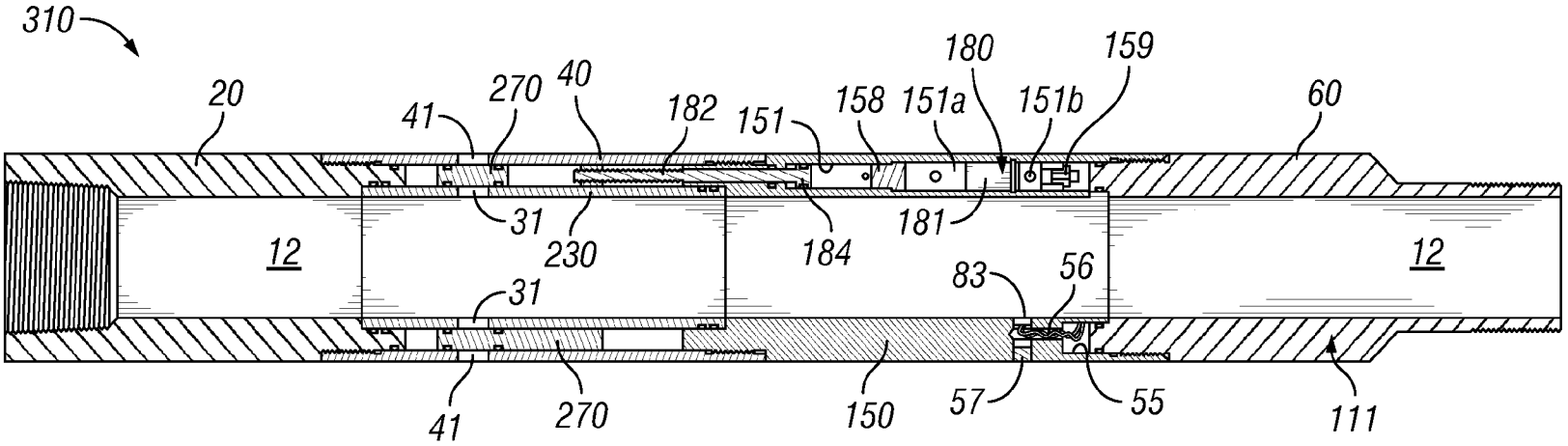
FIG. 9 is an axial cross-sectional view, similar to the views of FIGS. 3A, 6A, and 7, showing a fourth preferred embodiment 310 of the novel frac valves in its closed or run-in position.

A fourth preferred frac valve 310 is illustrated in FIG. 9. Frac valve 310 is similar in many respects to valve 110, and it may be used and operated in a production liner in the same manner as valves 10, 110, and 210. More particularly, as may be seen in FIG. 9, frac valve 210 generally comprises a housing 111, sliding sleeve valve body 270, and hydraulic actuator 180. Housing 111 in turn generally comprises top connection sub 20, inner wall sleeve 230, outer wall sleeve 40, actuator housing sleeve 150, and bottom connection sub 60. Valve body 270 is slidably mounted in housing 111 between inner wall sleeve 230 and outer wall sleeve 40. Housing 111 defines an axial, central conduit 12 through which well fluids may pass and which, as in valve 110, has a substantially uniform diameter.

Housing 111 is provided with ports 31 and 41. Valve body 270 is adapted for movement between a closed position, shown in FIG. 9, in which fluid communication through ports 31 and 41 is shut off, and an open position, similar to the position of valve body 70 in valve 110 shown in FIG. 6B, in which fluid may flow through ports 31 and 41. Thus, when valve body 270 is in its open position, fluid is able to flow between housing conduit 12 and the exterior of valve 310.

In contrast to valve 110, but similar to valve 210, valve 310 incorporates inner wall sleeve 230, which lacks ports 32 and 33 provided in inner wall sleeve 30 of valve 110. Instead, like valve 210, valve 310 incorporates valve body 270 which is provided with four passageways 272 which extend axially through valve body 270. As valve body 270 reciprocates within the annular space between inner wall sleeve 230 and outer wall sleeve 40, therefore, displaced fluid is able to flow through passageways 272 from one side of valve body 270 to the other.

Exemplified valves 10, 110, 210, and 310 have been disclosed and described as being assembled from a number of separate components. For example, housing 11 is assembled from five major components. Workers in the art will appreciate that various of those components and other tool components may be combined and fabricated as a single component if desired. By utilizing such separate components, however, the novel tools may be more easily fabricated and assembled. Utilizing separate components also provides the tool with greater adaptability and serviceability. Access to the actuator components, for example, may be easily provided by removing the bottom connection sub 60. Different flow rates for the valves also may be provided by changing out only the inner and outer sleeve walls 30 and 40 for sleeves having larger or smaller, or more or fewer ports.

Otherwise, the retrieval tools of the subject invention may be made of materials and by methods commonly employed in the manufacture of oil well tools in general and valves in particular. Typically, the various major components will be machined from relatively hard, high yield steel and other ferrous alloys by techniques commonly employed for tools of this type.

The novel valves may be used to advantage in any number of well operations, and other aspects of the subject invention are directed to novel methods for controlling the flow of fluids out of a liner using one or more embodiments of the novel valves. The advantages derived from the novel valves, however, perhaps are best appreciated in the context of a multi-stage fracking operations, especially when the liner is cemented in place prior to fracking.

Fracturing a formation in multiple stages can be accomplished in less time by using a liner having a series of novel valves instead of many conventional liner assemblies. Actuating the novel valves as required to fracture various zones can be accomplished more quickly and efficiently than a time consuming process of running and setting perf guns and plugs. The production liner also does not have to be drilled out in order to allow production of hydrocarbons, as may be necessary in plug and perf operations or when conventional ball drop valves are used. Once fracking is complete, all that is required to allow hydrocarbons to flow into the liner is to open the valves. Moreover, as compared to conventional ball drop valves, a greater number of novel valves may be incorporated into, and therefore a greater number of zones may be fractured using a single liner.

A typical multi-stage fracking operation may be initiated by making up a production liner containing a series of valves, such as valves 10 in liner 2 shown in FIG. 1. Liner 2 may be run into a well bore and installed near the lower end of host casing 4, for example, by a liner hanger 5. Valves 10 will be in their closed, run in position. If the frac job will be performed on an open hole, the production liner also will incorporate a series of packers that will be set to seal off and isolate various zones in the well bore. If not, the liner will be cemented in place by pumping a plug of cement down the production liner, out the bottom of the liner, and into the annulus between the liner and well bore. The cement will be allowed to harden and encase the liner, for example, as shown in FIG. 1, where cement 7 has encased production liner 2.

Installing a liner with the novel frac valves may be performed by conventional methods and utilizing any number of widely available tools and supplies as are used in installing conventional liners. It will be appreciated, however, that in cementing the well it is essential to ensure that cement is pumped completely through a liner, or at least through those portions in which valves are installed and that pass through what will be producing formations. Even small amounts of cement hung up in a liner, however, may harden and interfere with the operation of equipment in the liner. Thus, wiper darts, plugs or the like (not shown) will be used to push cement through a liner and ensure that the internal conduit is wiped clean of any residual concrete that may impede flow of hydrocarbons or interfere with the operation of liner equipment.

Conventional ball drop frac valves, for example, are commonly used to frac cemented liners. The ball seat in the valve, if not other features as well, present various profiles as a wiper dart or plug travels through a liner conduit. Those profiles may make it difficult to ensure that cement is wiped clean from the valve as the liner is cemented in the well bore. On the other hand, it is generally possible to apply relatively high actuation forces to the sleeve of a ball drop valve and thus overcome bits of hardened cement that may have hung up in the valve.

An RFID controlled sliding sleeve valve, however, does not have that advantage. The actuation force generated by a RFID controlled linear or hydraulic actuator is significantly less than the force that may be applied through a seated ball. Thus, cement hanging up in a sliding sleeve valve presents a greater concern.

For example, some conventional RFID controlled valves incorporate a sliding sleeve that is mounted on the interior of the tool housing. The housing typically is provided with a recess to accommodate the sleeve in a position flush with the inner diameter of the conduit. Even so, the sleeve necessarily must slide from its closed to its open position and cannot occupy the entire recess, leaving space into which cement will flow. Wiper plugs may not be able to remove cement from the recess. Once hardened, cement caught in the recesses may make it difficult or impossible to actuate the sleeve given the relative low actuation forces generated by RFID controlled actuators.

It also will be appreciated that frac fluids typically include proppants which are intended to help keep newly formed fractures open after pumping has stopped. The proppants commonly are gritty, abrasive materials, such as grains of sand, ceramic or other particulates. If a sleeve is mounted on the interior of a frac valve, as in many sliding sleeve valves, the proppants may work their way into recesses and jam the sleeve. Again, such issues may be easily overcome where relatively high actuation forces can be applied to the sleeve, as in ball drop valves, but not necessarily so where the sleeve is actuated by an RFID controlled actuator.

In contrast to such conventional sliding sleeve valves, various embodiments of the subject invention provide a conduit which has a substantially uniform diameter. For example, conduit 12 in valves 10, 110, 210, and 310 all have a substantially uniform diameter that is substantially free of any profiles or recesses other than ports 31. Pressure relief ports 32 and 33 in inner wall sleeve 30 of valves 10 and 110 preferably are shut off by burst valves (not shown) or the like prior to actuation of valves 10 and 110, and are absent in inner wall sleeve 230 of valves 210 and 310. Regardless, given that valve body 70 and 270 are mounted, respectively, between an inner wall and an outer wall, the space through which valve bodies 70 and 270 will travel as ports 31 and 41 are opened is more isolated from cement passing through conduit 12. Cement is less likely, therefore, to flow into that space, harden, and interfere with actuation of valve bodies 70 and 270. Moreover, a wiper plug is better able to wipe the surface of conduit 12.

It also will be appreciated that more and more commonly, operators choose to or are required to pressure test a production liner after it has been installed in a well. The testing is done before the liner is perforated, or any frac valves are opened to ensure that the liner is leak free. Aside from costs associated conducting the test, pressure testing can drive up the cost of many conventional liner assemblies.

That is, many conventional liner assemblies use a hydraulic initiator valve, the initiator valve being the first valve that is opened when a frac job is started. Hydraulic initiator valves are opened by increasing the fluid pressure in the liner to a predetermined level. That actuation pressure necessarily will be significantly higher than any required test pressures for the liner assembly. The casing used to make up the liner, therefore, will have to be rated to withstand not only the required test pressure, but also the higher pressures required to open a hydraulic initiator valve. Higher rated casing generally has thicker walls and always has higher unit costs.

On the other hand, the novel valves are not opened by increasing the hydraulic pressure in the liner. They are opened in response to an activation signal received from a transmitter passed through the valve. Thus, when used as the initiator valve in a production liner, the casing need be rated only up to the test pressure, not some higher actuation pressure. Other factors being equal, a production liner may be assembled from less expensive, lower rated casing.

In any event, once liner 2 has been encased in cement and the cement has been allowed to harden, valves 10 will be opened and closed in a desired sequence to allow fracturing of all the zones 9 in the formation. More specifically, they will be opened and closed by passing various transmitters through the liner conduit. The transmitters generate signals that are picked up by receivers in incorporated into the actuator. The actuators in one or more of the valves will recognize those signals as activation signals and operate the valve in accordance with those signals.

For example, actuators 80 of valves 10 may be provided with an active RFID reader incorporating receiver 83. Passive RFID tags, such as tag 84, may be passed through conduit 12 to transmit appropriate activation signals to receiver 83. The RFID tags may be programmed to simply transmit an identification signal, but preferably the tags will be programmed to transmit additional data in response to signals received from the reader. The activation signal may correspond to any desired actuation or operation of the valves, such as open valve, shut valve, or open or shut valve after defined time delays. The activation signal also may correspond to an interrogation signal prompting the reader to transmit information about the state of the valve, for example, is the valve open or is it closed. Similarly, a single tag may be programmed to provide activation signals for a single valve, for some valves, or all the valves in a production liner, and multiple tags may be used to control a single valve.

A first RFID tag, for example, may programmed to transmit a signal which will be recognized by lower most valve 10*a* as a signal to actuate motor 81 to move valve body 70 to its open position uncovering ports 31 and 41. In addition to the "open valve" signal intended for valve 10*a*, the tag also may be programmed to transmit a "shut valve" signal to valves 10*b* to 10*w* to ensure that they are shut before fracking is commenced through valve 10*a*. That is, the controllers in valves 10*b* to 10*w* could be programmed to recognize the signal transmitted by the RFID tag as a signal to close the valves.

Any suitable means for transporting the RFID tag or other transmitter through a liner conduit may be used. The tag, for example, may be passed through a liner on a wireline. Preferably, however, it is dropped into a well and allowed to sink through or be carried by well fluids through the liner. Most preferably, a RFID tag or other transmitter will be incorporated into a carrier device, such as a ball, dart, plug, or similar device, which is able to transport the transmitter through the liner in a more reliable and predictable manner.

It will be appreciated that any tags or carriers used in controlling the novel should not create any significant issues in fracturing a zone or in allowing subsequent production through a liner. Thus, for example, balls or other carrier devices used to carry tags into the liner may be composed of materials such that the carrier dissolves after a period of time. The tags and any carrier device also typically will be sized to pass out of the valve. In respect to valve 10*a*, which serves as an initiator valve, the tag preferably is carried in a wiper dart during the cementing operation. Preferably, the tag will be programmed with instructions for valve 10*a* to open after a time delay sufficient to allow hardening of cement in the well.

Fluids then will be introduced into liner 2 and allowed to flow out valve 10*a* until fractures have been established in that part of the formation. As or after that zone is fractured, another RFID tag may be introduced into the liner, for example, by incorporating it into a weighted ball. The second tag may be programmed to transmit a "shut valve" signal to valve 10*a*. Preferably, however, the second tag is encoded with an "open valve" signal for the next upstream valve, valve 10*b*, and a "shut valve" signal for valve 10*a*. Preferably, the signal would instruct valve 10*b* to open after a time delay sufficient to ensure that RFID tag has passed completely through valve 10*b* before it opens. Doing so increases the likelihood that the ball will reach valve 10*a* and transmit the "shut valve" signal to that valve.

Once the formation has been fractured in the zone adjacent valve 10*b*, valve 10*b* may be shut and valve 10*e* opened by a similar process so that the next zone may be fracked. That process then may be repeated by dropping additional tags through the liner as are necessary to control the remaining valves 10 to fracture the rest of the zones.

The process described above, where individual valves are opened and shut to fracture successive zones starting from the bottom and continuing up the well, is commonly practiced in the industry. At times, however, operators may prefer to fracture more than one zone at a time or to fracture zones in a different order. Accordingly, other embodiments of the invention allow frac jobs to be performed in any sequence that may be desired.

For example, an operator may wish to fracture formation, such as formation 6 shown in FIG. 1, two zones 9 at a time. An initial tag may be programmed and dropped, for example, in a wiper dart, to open valves 10*a* and 10*b*. After the zones adjacent valves 10*a* and 10*b* have been fractured, another tag may be dropped, for example, in a ball. The second tag would have instructions to open valves 10*c* and 10*d*, preferably after a time delay, and to shut valves 10*a* and 10*b*. That process may be repeated until, for example, a ball is dropped instructing valves 10*y* and 10*z* to open and valves 10*w* and 10*x* to close.

It will be appreciated, however, that if the carrier ball is sized to pass through ports 31 and 41 in valves 10, there is a risk that they may be swept out through an open valve before they are able to pass through a lower valve with a "shut valve" signal. For example, if a ball is intended to transmit a "shut valve" signal to open valves 10*a* and 10*b*, it may be swept out through ports 31 and 41 in valve 10*b*, the uphole valve, before they reach valve 10*a*. In that event, valve 10*a* would remain open, and fluids would be able to continue to flow into the already fractured zone adjacent to valve 10*a* as the zones adjacent to valves 10*c* and 10*d* are being fractured. This in turn can cause the former zone to be fractured to a greater degree, and the latter zones fractured to a lesser degree than may be desired.

Thus, other embodiments of the novel valves and methods provide that valve ports and tags are sized relative to each other to preclude a tag from flowing out ports in an upstream valve, but allow the tag to flow out a downstream valve. For example, valves 10*a*, 10*c*, 10*w*, and 10*y* in liner 2 may be provided with ports 31 and 41 that are somewhat larger than ports 31 and 41 in valves 10*b*, 10*d*, 10*x*, and 10*z*. A ball carrying a tag with a "shut valve" signal intended for valves 10*a* and 10*b*, for example, may be sized so that it is able to pass through ports 31 and 41 of valve 10*a*, but not through ports 31 and 41 of valve 10*b*. The tag and its "shut valve" signal, therefore, could not be swept out valve 10*b* before it could reach valve 10*a*.

Similarly, if an operator wishes to fracture a particular zone before a downhole zone is fractured, the relative sizes of valve ports and a carrier ball could be coordinated in a similar manner. The uphole valve would have smaller ports than the downhole valve, and the carrier would be sized to prevent passage of the tag out of the upstream valve and allow it to pass out the downstream valve. Thus, once the uphole zone was fractured, a "shut valve" signal may be provided to the upstream valve while ensuring that the ball delivers an "open valve" signal to the downstream valve.

It also will be appreciated that the novel valves have been exemplified primarily in the context of well fracturing operations. The novel valves, however, are not limited to use as frac valves. They may be used to advantage in other types of well operations where is necessary to control the flow of fluid between the interior of a tubular conduit and the well annulus. For example, the novel valves may be adapted for assembly into a drill string and used as a circulation diverter tool. They also may be incorporated into a liner as a stage cementing control, that is, to allow a liner to be cemented in stages.

While this invention has been disclosed and discussed primarily in terms of specific embodiments thereof, it is not intended to be limited thereto. Other modifications and embodiments will be apparent to the worker in the art.

What is claimed is:

1. A frac valve for a well liner, said frac valve being adapted for use in fracturing a well formation and comprising:

(a) a cylindrical housing adapted for assembly into said liner for a well and defining a conduit for passage of fluids through said housing;

(b) said housing having an inner wall and an outer wall, said inner wall and said outer wall being spaced from each other to define an annular space therebetween and each having a plurality of ports therein allowing passage of fluids between said conduit and the exterior of said housing;

(c) a valve body mounted in said annular space between said inner wall and said outer wall, said valve body comprising a cylindrical sleeve which is repeatably moveable between a closed position in which fluid communication between said ports is shut off and an open position in which fluid may flow between said conduit and the exterior of said housing through said ports; and (d) an actuator adapted to move said sleeve between said closed position and said open position;

(e) wherein said actuator comprises a receiver adapted to receive an activation signal from a transmitter introduced into said conduit; and (f) wherein said valve body defines a passage allowing fluid displaced by movement of said valve body to flow between portions of said annular space above said valve body and portions of said annular space below said valve body.

2. The frac valve of claim 1, wherein said activation signal is a signal to move said valve body between said closed position and said open position after a time delay.

3. The frac valve of claim 1, wherein said receiver is a radio frequency identification receiver and said transmitter is a radio frequency identification transmitter.

4. The frac valve of claim 1, wherein said conduit has a substantially uniform diameter.

5. The frac valve of claim 4, wherein said activation signal is a signal to move said valve body between said closed position and said open position after a time delay.

6. The frac valve of claim 4, wherein said receiver is a radio frequency identification receiver and said transmitter is a radio frequency identification transmitter.

7. The frac valve of claim 6, wherein said actuator is a linear actuator.

8. The frac valve of claim 4, wherein said actuator is a linear actuator.

9. The frac valve of claim 4, wherein said actuator is a hydraulic actuator.

10. The frac valve of claim 1, wherein said actuator is a linear actuator.

11. A liner adapted for installation in a well comprising the frac valve of claim 4.

12. A method of fracturing a formation in a well, said method comprising:

(a) installing a liner in said well, said liner comprising first and second frac valves of claim 1;

(b) opening said first frac valve by introducing a transmitter into said housing conduit, said transmitter being encoded with an activation signal, whereby said activation signal is received by said receiver and said actuator is activated to move said valve body from said closed position to said open position;

(c) pumping fluid through said opened first frac valve to fracture said formation;

(d) shutting said first frac valve by introducing a transmitter into said housing conduit, said transmitter being encoded with an activation signal, whereby said activation signal is received by said receiver and said actuator is activated to move said valve body from said open position to said closed position;

(e) opening said second frac valve by introducing a transmitter into said housing conduit, said transmitter being encoded with an activation signal, whereby said activation signal is received by said receiver and said actuator is activated to move said valve body from said closed position to said open position; and (f) pumping fluid though said opened second frac valve to fracture said formation.

13. The method of claim 12, wherein said receiver is a radio frequency identification receiver and said transmitter is a radio frequency identification transmitter.

14. A method of fracturing a formation in a well, said method comprising:

(a) installing a liner in said well, said liner comprising first and second frac valves of claim 4;

(b) opening said first frac valve by introducing a transmitter into said housing conduit, said transmitter being encoded with an activation signal, whereby said activation signal is received by said receiver and said actuator is activated to move said valve body from said closed position to said open position;

(c) pumping fluid through said opened first frac valve to fracture said formation;

(d) shutting said first frac valve by introducing a transmitter into said housing conduit, said transmitter being encoded with an activation signal, whereby said activation signal is received by said receiver and said actuator is activated to move said valve body from said open position to said closed position;

(e) opening said second frac valve by introducing a transmitter into said housing conduit, said transmitter being encoded with an activation signal, whereby said activation signal is received by said receiver and said actuator is activated to move said valve body from said closed position to said open position; and (f) pumping fluid though said opened second frac valve to fracture said formation.

15. The method of claim 14, wherein said installation of said liner comprises cementing said liner in said well.

16. The method of claim 15, wherein said receiver is a radio frequency identification receiver and said transmitter is a radio frequency identification transmitter.

17. The method of claim 14, wherein said method comprises opening said first frac valve by introducing a first transmitter, said first transmitter being encoded with a first activation signal to activate said actuator to open said first frac valve, and closing said first frac valve and opening said second frac valve by introducing a second transmitter, said second transmitter being encoded with a second activation signal to activate said actuator of said first frac valve to close said first frac valve and to activate said actuator of said second frac valve to open said second frac valve.

18. The method of claim 17, wherein said second activation signal is received by said receiver in said second frac valve and said actuator in said second frac valve is activated to move said valve body from said closed position to said open position after a time delay, whereby said second frac valve is opened after said first frac valve is closed.

19. The method of claim 17, wherein said receiver is a radio frequency identification receiver and said transmitter is a radio frequency identification transmitter.

20. The method of claim 1, wherein said receiver is a radio frequency identification receiver and said transmitter is a radio frequency identification transmitter.

* * * * *

UNITED STATES PATENT AND TRADEMARK OFFICE

CERTIFICATE OF CORRECTION

PATENT NO. : 9,051,810 B1
APPLICATION NO. : 14/305099
DATED : June 9, 2015
INVENTOR(S) : Christopher J. Cuffe et al.

It is certified that error appears in the above-identified patent and that said Letters Patent is hereby corrected as shown below:

In the Claims

In claim 20, at column 21, line 12, delete "claim 1" and insert therein -- claim 14 --.

Signed and Sealed this
Third Day of November, 2015

Michelle K. Lee

Michelle K. Lee
*Director of the United States Patent and Trademark Office*